US005992401A

United States Patent [19]

Bylsma et al.

[11] Patent Number: 5,992,401

[45] Date of Patent: Nov. 30, 1999

[54] CAPACITIVE DISCHARGE IGNITION FOR AN INTERNAL COMBUSTION ENGINE

[75] Inventors: Philip J. Bylsma, Brookfield; Michael J. French, Kenosha, both of Wis.

[73] Assignee: Outboard Marine Corporation, Waukegan, Ill.

[21] Appl. No.: 08/926,918

[22] Filed: Sep. 10, 1997

[51] Int. Cl.[6] ..... F02P 3/06

[52] U.S. Cl. ..... 123/596; 315/209 M; 315/209 CD; 361/247; 361/257

[58] Field of Search ..... 123/594, 596, 123/599, 620, 143 B, 146, 152; 361/254, 247, 257, 258; 315/209 CD, 209 SC, 209 M

[56] References Cited

U.S. PATENT DOCUMENTS

| | | | |
|---|---|---|---|
| 3,334,619 | 8/1967 | Penn | 123/148 |
| 3,383,555 | 5/1968 | Minks | 315/209 CD |
| 3,405,327 | 10/1968 | Cole et al. | 317/151 |
| 3,573,562 | 4/1971 | Hanson et al. | 317/123 |
| 3,651,341 | 3/1972 | Shano | 307/246 |
| 3,677,255 | 7/1972 | Withem | 315/209 CD |
| 3,800,771 | 4/1974 | Mackie | 123/148 |
| 3,882,839 | 5/1975 | Ganoung | 315/209 CD |
| 4,318,155 | 3/1982 | Thomas | 361/156 |
| 4,958,608 | 9/1990 | Saito et al. | 123/146.5 D |
| 4,969,443 | 11/1990 | DeBiasi | 123/630 |
| 4,974,114 | 11/1990 | Kammerer | 361/159 |
| 5,531,206 | 7/1996 | Kitson et al. | 123/596 |
| 5,600,293 | 2/1997 | Hunter | 123/143 B |
| 5,602,446 | 2/1997 | Kolber et al. | 315/241 |

*Primary Examiner*—Willis R. Wolfe
*Assistant Examiner*—Hieu T. Vo.
*Attorney, Agent, or Firm*—Fletcher, Yoder & Van Someren

[57] ABSTRACT

A capacitive discharge ignition system deriving the ignition pulse from a capacitor storing the flyback voltage induced from the fuel injector coil when the pulse supplied to the fuel injector coil is removed.

5 Claims, 1 Drawing Sheet

CAPACITIVE DISCHARGE IGNITION FOR AN INTERNAL COMBUSTION ENGINE

BACKGROUND OF THE INVENTION

1. Field of the Invention

The present invention relates generally to capacitive discharge ignition circuits to ignite the fuel mixture in a combustion chamber and specifically relates to such capacitive discharge ignition used with outboard motors to ignite the fuel mixture in the combustion chamber. Capacitive discharge ignition requires a charging voltage to charge a capacitor to approximately 300 volts. An electronic circuit then triggers a switch to discharge the capacitor to an ignition coil that generates a high voltage spark.

2. Description of Related Art Including Information Disclosed Under 37 CFR 1.97 and 1.98

It is well known in the prior art to recover energy from an inductive load that is created when the inductive load is switched off. In U.S. Pat. No. 4,318,155 residual magnetism in the engageable members of an electromagnetic clutch is relieved following de-energization of the clutch coil by charging a capacitor with the inductive energy stored in the coil at de-energization thereof and subsequently discharging the capacitor into the coil in a direction opposite to that applied to the coil during energization.

In U.S. Pat. No. 4,974,114 an energy recovery system is disclosed in which, when drive power is removed from the inductive load by switching off the drive transistors, a reverse EMF is established in the inductive load and as the inductive load magnetic field collapses, a reverse voltage is developed that is higher than the applied voltage to forward bias diodes. Thus, current flows from the inductive load through diodes to the storage capacitor for use with the next charging cycle of the transducer.

In the operation of some outboard internal combustion motors, electrical requirements may begin to exceed available power because of limited space on the stator. The alternator coils must share space with charge coils for CD (capacitive discharge) ignition. By using only alternator coils on the stator, electrical power could increase significantly. Without charge coils, there must be an alternative way to provide the high voltage needed for CD ignition.

Inasmuch as the fuel injector coil already exists as one of the elements of the internal combustion outboard motor and inasmuch as it generates a flyback voltage when the voltage is removed therefrom, it would be convenient to use the existing injector coil to provide the voltage for the ignition system. In one such fuel injector, a large flyback voltage is generated when current flow to the solenoid is cut off. Solenoids typically use a flyback diode to control this voltage but in this case it cannot be used because a flyback diode will not allow the injector to run at its required maximum frequency. Therefore, the electronic switching device that turns the injector ON and OFF must be capable of dissipating the energy that is generated when the coil is shut off. This is usually done with an electronic switch containing an integral zener diode. In one such transistor switch, the voltage at which the integral zener diode begins conducting is between 350 and 400 volts. So when the fuel injector is shut off, the flyback voltage climbs to about 350 volts before the integral zener diode turns ON and shunts to ground.

It would be advantageous to use that flyback voltage to charge the capacitor that is used for capacitive discharge ignition.

SUMMARY OF THE INVENTION

In the present invention, a zener diode is used to redirect the high flyback voltage from the fuel injector coil to a charge capacitor. A signal from the ECU can then trigger a switch to discharge the capacitor to the ignition coil to cause the spark. Thus the flyback voltage energy is not wasted or shunted to ground but rather is stored in a capacitor until a predetermined time at which a switch is activated to enable the voltage stored in the capacitor to be coupled to the ignition coil to provide the spark.

Thus, it is an object of the present invention to provide a capacitive discharge ignition for an internal combustion engine utilizing the flyback voltage from a fuel injector coil.

It is also an object of the present invention to store the flyback voltage from the injector coil until the time necessary to provide the ignition signal.

It is still another object of the present invention to provide a silicon controlled rectifier as the switch that couples the voltage from the storage capacitor to the ignition coil.

It is yet another object of the present invention to use the engine control unit (ECU) for providing a gating signal to the silicon controlled rectifier to cause it to conduct at the proper time to provide the spark to the ignition coil.

Thus, the present invention relates to a capacitive discharge ignition for an internal combustion engine cylinder comprising a fuel injector coil for developing a flyback voltage when fuel is injected into the engine cylinder, an ignition coil for providing an ignition pulse for said fuel in said cylinder, a capacitor electronically coupled to the fuel injection coil for recovering and storing the flyback voltage, and a switch coupled between the capacitor and the ignition coil for selectively causing the stored flyback voltage to be coupled to the ignition coil to provide the ignition pulse.

BRIEF DESCRIPTION OF THE DRAWINGS

These and other features of the present invention will be more fully disclosed when taken in conjunction with the following DETAILED DESCRIPTION OF THE PREFERRED EMBODIMENT(S) in which like numerals represent like elements and in which.

DETAILED DESCRIPTION OF THE PREFERRED EMBODIMENT(S)

Figure 1:
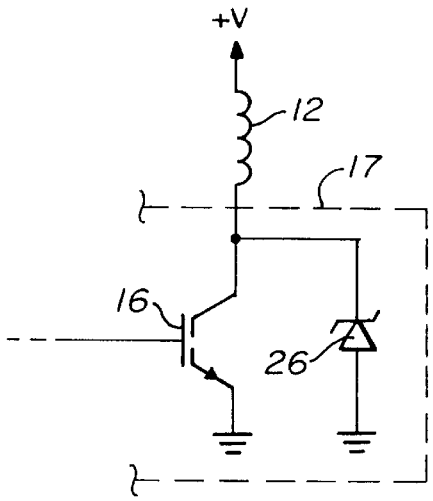
FIG. 1 PRIOR ART
FIG. 1 is an example of the prior art circuit for providing the electronic pulse to the fuel injector and the circuit for discharging the flyback voltage generated.

FIG. 1 is a circuit diagram of the prior art fuel injector circuit. Coil 12 is the coil of the fuel injector which, when a pulse is applied thereto, causes the fuel injector to inject a predetermined amount of fuel mixture into the engine cylinder. The pulse is provided by a control device such as transistor 16 in the electronic control unit 17. The electronic control unit switches transistor 16 ON and OFF at the appropriate times to cause a voltage to be applied through coil 12 to activate the fuel injector and inject the fuel into the cylinder. When transistor 16 is shut off and the pulse is removed from coil 12, a flyback voltage is generated because of the inductive nature of coil 12 and zener diode 26 conducts at an appropriate high-level voltage and shunts the flyback voltage to ground. This is a typical circuit for handling the flyback voltage generated by the fuel injectors.

Figure 2:
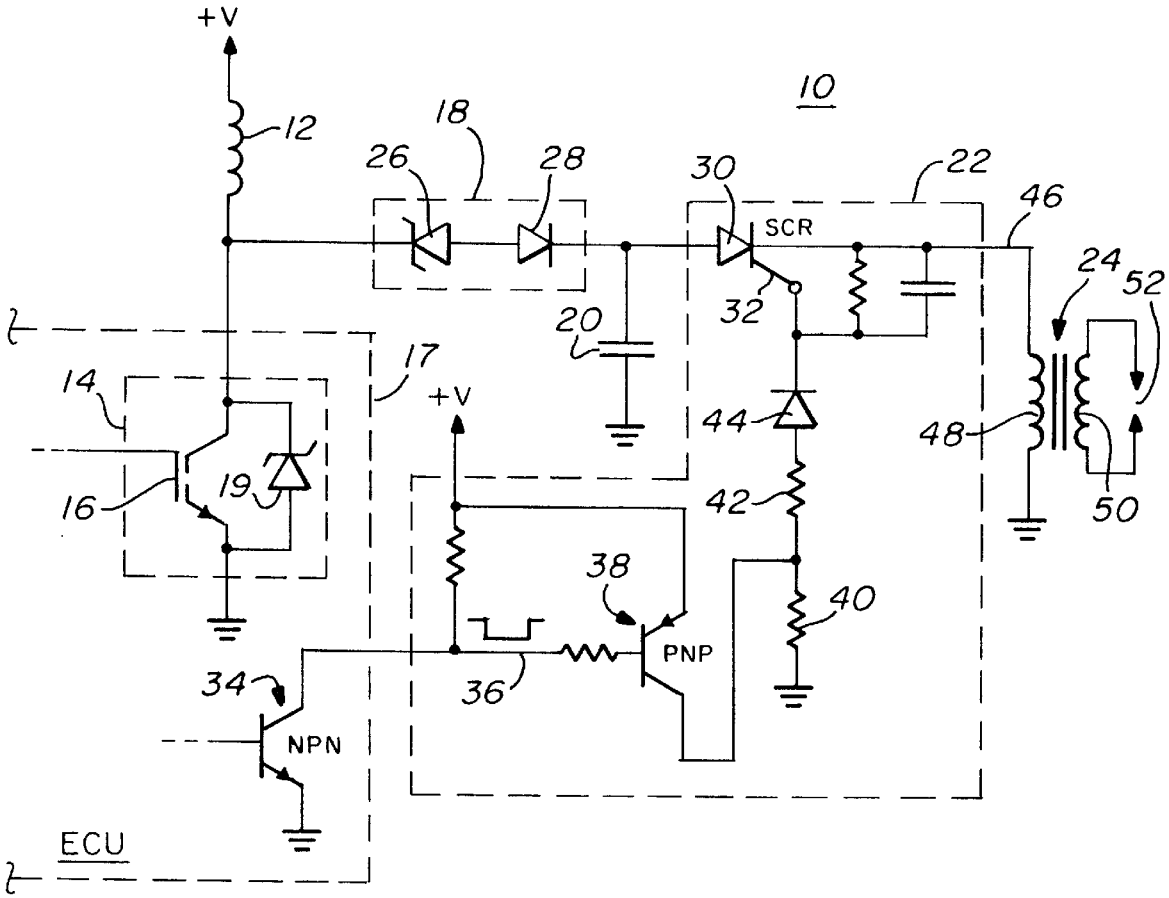
FIG. 2 is a circuit diagram of the present invention that utilizes the flyback voltage from the injector coil to provide the ignition pulse required to ignite the fuel injected into the cylinder.

The present invention utilizes the circuit of FIG. 2 to make use of the flyback voltage to provide an ignition pulse to ignite the fuel in the combustion chambers.

Circuit 10 shown in FIG. 2 includes the injector coil 12 again driven by a first circuit 14 which includes a transistor 16 in the ECU 17.

A second circuit 18 couples the flyback voltage generated by the injector coil 12 when the pulse is removed therefrom, to a storage capacitor 20 where it is stored. When switch 22 is activated, the voltage on capacitor 20 is coupled to ignition coil transformer 24 to cause the necessary ignition pulse.

Second circuit 18 includes a zener diode 26 and a freewheeling diode 28. When the flyback voltage from the injector coil 12 reaches a sufficient value such as, for example only, 30 volts, zener diode 26 conducts and the voltage passes through freewheeling diode 28 to storage capacitor 20, which is of a sufficient size to store the flyback voltage. Any voltage in excess of 350–400 volts is shunted through the integral zener diode 19.

Circuit 22 includes a silicon controlled rectifier 30 with an input electrode coupled to the capacitor 20, an output electrode coupled on line 46 to the ignition coil transformer 24, and a gate electrode 32 which, when it receives a pulse, causes the silicon controlled rectifier 30 to conduct.

The silicon controlled rectifier is switched ON and OFF by the ECU 17 through use of the third circuit 22. An NPN transistor 34 in the ECU is turned ON which causes a low output on line 36 to PNP transistor 38. This low output turns ON PNP transistor 38 which causes a voltage to develop across resistor 40. That voltage is coupled through resistor 42 and diode 44 to the gate 32 of the silicon controlled rectifier, thus turning it ON. When it is ON, the stored voltage on capacitor 20 is, as stated previously, coupled on line 46 to the input winding 48 of transformer 24 where it is inductively coupled to the output winding 50 and causes a spark across electrode 52. It is understood that any or all of circuits 18, 22 and capacitor 20 may be located in the ECU.

Thus, a novel circuit is disclosed which utilizes the injector coil flyback voltage to provide the ignition pulse signal to the ignition coil transformer 24 as needed. It can be seen that the same size alternator can be used with increased alternator capacity without having to enlarge it to add capacitor charge coils.

The corresponding structures, materials, acts, and equivalents of all means or step plus function elements in the claims below are intended to include any structure, material, or act for performing the function in combination with other claimed elements as specifically claimed.

We claim:

1. A capacitive discharge ignition for an internal combustion engine cylinder comprising:

a fuel injector coil that develops a flyback voltage when fuel is injected into the engine cylinder;

an ignition coil for providing an ignition pulse for said fuel in said cylinder;

a capacitor electrically connected to the fuel injection coil for receiving and storing said flyback voltage; and a switch connected between the capacitor and the ignition coil for selectively causing the stored flyback voltage to be coupled to the ignition coil to provide the ignition pulse.

2. The capacitive discharge ignition of claim 1 further comprising a zener diode and a freewheeling diode connected in series between the fuel injector coil and the capacitor to couple the flyback voltage to the capacitor for storage.

3. The capacitive discharge ignition of claim 2 wherein said switch comprises:

a silicon controlled rectifier having an input electrode coupled to the capacitor, an output electrode coupled to the ignition coil, and a gate electrode; and a signal generator coupled to the gate electrode for causing the silicon controlled rectifier to conduct the stored capacitive voltage to the ignition coil.

4. The capacitive discharge ignition of claim 3 further comprising an engine control unit for providing a pulse to the signal generator for causing the silicon controlled rectifier to conduct and supply the stored capacitor voltage to the ignition coil.

5. A capacitive discharge ignition for an internal combustion engine having at least one cylinder and comprising:

a fuel injector having a coil for causing fuel to be injected into the at least one cylinder;

a first circuit for providing a pulse to the injector coil to cause the injection of fuel into the engine cylinder;

a flyback voltage generated by the injector coil when the pulse is removed from said injector coil;

an ignition coil for providing an ignition pulse to the injected fuel in the at least one cylinder;

a capacitor;

a second circuit connected between said generated flyback voltage and said capacitor for charging said capacitor with said generated flyback voltage; and a third circuit connected between the capacitor and the ignition coil for causing the charged capacitor to discharge the stored voltage to the ignition circuit and cause said ignition pulse.

* * * * *